United States Patent [19]

Milam et al.

[11] 4,368,594

[45] Jan. 18, 1983

[54] STORM WINDOW

[75] Inventors: William O. Milam; Ransoma L. Morrow, both of Portland, Oreg.

[73] Assignee: Milam Corporation, Portland, Oreg.

[21] Appl. No.: 233,936

[22] Filed: Feb. 12, 1981

[51] Int. Cl.[3] ..... E05B 65/04

[52] U.S. Cl. ..... 49/67; 52/202

[58] Field of Search ..... 49/57, 56, 67, 61, 62, 49/465, 466; 52/202, 203; 160/369

[56] References Cited

U.S. PATENT DOCUMENTS

| | | | |
|---|---|---|---|
| 1,412,460 | 4/1922 | Dickinson | 49/465 X |
| 1,646,522 | 10/1927 | Berg | 49/67 X |
| 1,776,160 | 9/1930 | Le Ber | 49/67 |
| 2,142,690 | 1/1939 | Goserud | 49/67 X |
| 2,720,260 | 10/1955 | Plucinski | 160/369 X |
| 3,269,455 | 8/1966 | Gillotti | 160/369 |

FOREIGN PATENT DOCUMENTS

| | | | |
|---|---|---|---|
| 504514 | 4/1939 | United Kingdom | 49/57 |
| 709579 | 5/1954 | United Kingdom | 49/61 |

*Primary Examiner*—Philip C. Kannan

*Attorney, Agent, or Firm*—Hill, Van Santen, Steadman, Chiara & Simpson

[57] ABSTRACT

The present invention concerns a new and improved storm window and window suspension arrangement for mounting a storm window frame in assembly with a frame of a window on a building. The storm window frame has a continuous annular resilient synthetic plastic spacer mounted on an inwardly facing surface of the frame for abutment against the frame carrying the window, and spring-loaded fasteners extend through the storm window frame for compressing the continuous annular resilient synthetic plastic spacer throughout its annular dimension and for securing the storm window frame in retained engagement with the window frame of the window, thus insuring a snug air-tight assemblage of the storm window on the window frame of the window. The storm window has an annular inwardly facing retaining groove with the synthetic plastic spacer being retainingly engaged and retained in the groove. The plastic spacer when in the groove is positioned offset of an inside face of a storm window frame so that it can come into direct contact with the window frame. The fasteners serve to insure snug engagement of the storm window frame with the window frame. The window suspension arrangement also includes a window venting arrangement so that air can be admitted through the window frame, when desired.

10 Claims, 7 Drawing Figures

STORM WINDOW

The present invention relates to a new and improved storm window structure including a storm window that is self-sealing and self-mounting when assembled over a window structure.

An important object of this invention is to provide a new and improved energy-saving storm window of the type having an air infiltration rate below 0.50 cfm/fcp. (Cubic feet of air per foot of crack perimeter). Current storm window air infiltration standards call for rating of no more than 4.00 cfm/fcp. (Established by the Architectural Aluminum Manufacturers Association), although a reduction to 2.00 cfm/fcp has been proposed. The average storm window on the market today has an air infiltration rating of 2.38 cfm/fcp, which hardly saves a user any energy because the prime window and the storm window leak at an average of 3.00 cfm/fcp. To have an energy saving effect, a storm window should have an infiltration rating of 0.50 cfm/fcp or less. The new and improved storm window structure herein disclosed has the much preferred capability of being installed with a 0.50 cfm/fcp rating or less with little additional cost to consumers.

According to important features of the present invention a storm window structure has been provided which includes a storm window for protectively screening out cold air, dirt and the like when mounted upon a window frame carrying at least one window. The improvement of a window suspension arrangement for mounting the storm window frame in assembly with the frame of the window, the storm window frame having a continuous annular resilient synthetic plastic spacer mounted on an inwardly facing surface of the frame for abutment against the frame carrying the window, and spring loaded fasteners extending through said storm window frame for compressing said continuous annular resilient synthetic plastic spacer throughout its annular dimension and for securing the storm window frame in retained engagement with the window frame of the window thus insuring a snug air-tight assemblage of the storm window on the window frame of the window.

According to the other features of the present invention, the window frame on the storm window has been provided with an annular inwardly facing retaining groove and with the continuous annular resilient synthetic plastic spacer being retainingly engaged and retained in said groove, at least some of the fasteners extending into the groove and through the spacer and in threaded engagement with the window frame carrying the window.

A further feature of the invention is characterized by the spring-loaded fasteners having rotatable locking dogs, and annular metallic strips are anchored to the window frame, each of the dogs being engageable with a rear surface of one of the metallic strips for securing the spring-loaded fasteners in releasable engagement therewith.

Yet another feature of the invention involves the releasable dogs being mounted to be rotatable for disengagement from the metallic angular member, and with the release of all of the dogs, the storm window frame is then pivotally movable at its bottom end relative to its points of pivotal engagement comprising the spring-loaded fasteners at a top side of the storm window frame, and a swingable arm is mounted on the storm window frame and engageable with the angular metallic piece for holding the window frame at its bottom end in an open position when it is desired to vent the storm window frame.

Other objects, features and advantages of the invention will be readily apparent from the following description of certain preferred embodiments thereof taken in conjunction with the accompanying drawings, in which.

DESCRIPTION OF THE PREFERRED EMBODIMENTS

Figure 1:
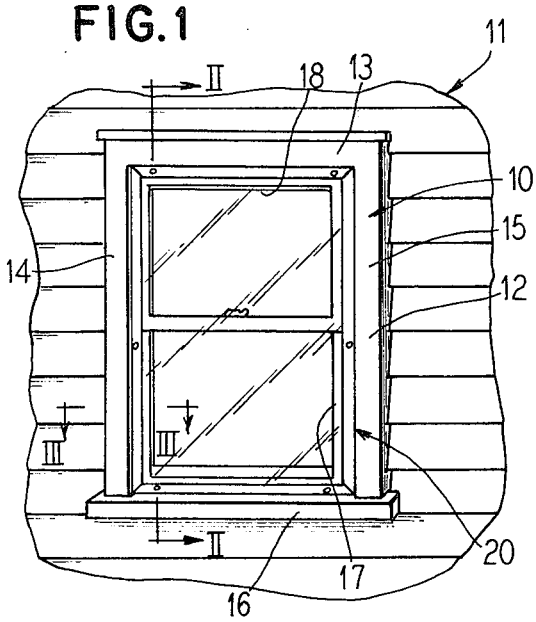
FIG. 1 is a fragmentary perspective view of a storm window structure embodying features of our invention.

The reference numeral 10 indicates generally a storm window structure. The structure 10 is shown to be mounted on a building 11. The structure includes a window frame 12 having a header 13, side jams 14 and 15 and a window sill 16. In the illustrated embodiment, double-hung windows 17 and 18 are mounted on the window frame and are operable in a conventional manner.

In order to conserve energy very many property owners follow the practice of installing storm windows upon the window frame 12 to shut out air and to prevent air leakage between the double-hung windows 17 and 18 and particularly their frames where engaged with the window frame 12. To attain this end, a storm window 20 has been provided having a metal frame 21 and a window pane 22 mounted on the frame in a conventional manner.

The storm window 20 has its metal frame 21 provided with an annular outer frame attachment flange 23 provided with screw holes 24 and slots 25. A new and improved window suspension arrangement 26 is provided for cooperation with the attachment flange 23, the screw holes 24 and the slots 25 for sealing the window 20 with respect to the double-hung windows 17 and 18 to greatly minimize air flow therethrough and to insure a snug air-tight assemblage of the storm window on the window frame of the windows. While in the illustrated embodiment, the window frame is illustrated as having double-hung windows, it will be appreciated that only a single window may be mounted on the frame 12.

Mounted within the annular slot 25 is a continuous annular resilient synthetic plastic spacer 28. This spacer is mounted on an inwardly facing surface 29 of the attachment flange or outer margin 23 of the metal frame 21. It wll be seen from an examination of FIG. 6 that the spacer has a bulb end 28a that protrudes outside of the groove or slot 25 and which is offset away from the storm frame surface 29 for engagement against the window frame 12 or against angular metallic strips 30 which are anchored to the window frame. The spacer 28 can be made of any suitable material such as vinyl and it will be noted from an examination of the spacer 28 in FIGS. 2 and 6 that the shape of the end of the spacer which engages the strip 30 or the frame 12 becomes compressed to provide a snug seal when the spring-loaded fasteners or screws 27 are drawn into snug engagement with the window frame 12.

Figure 2:
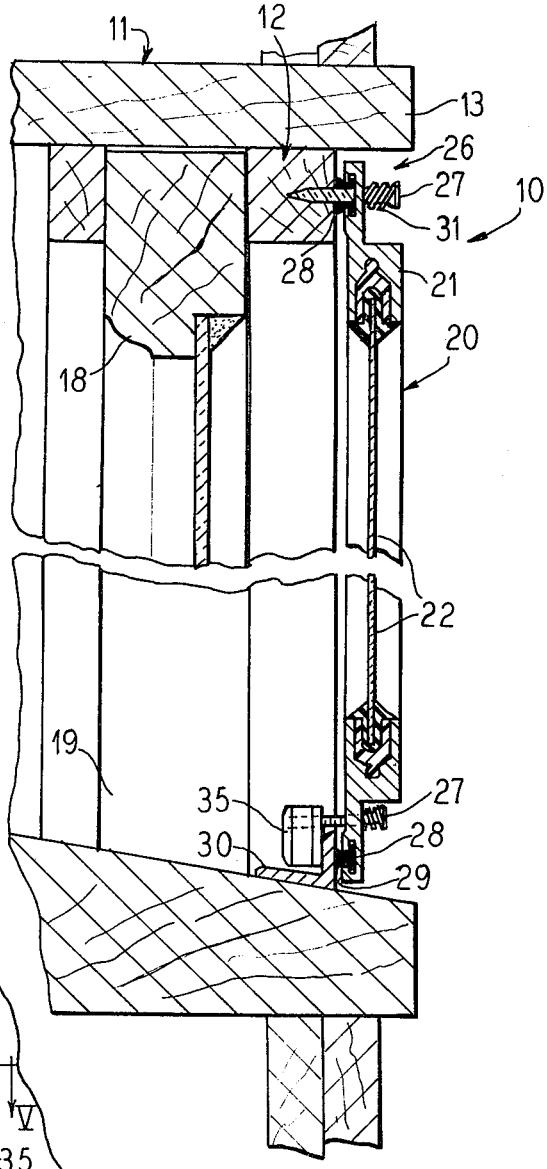
FIG. 2 is an enlarged fragmentary vertical section taken on the line II—II looking in the direction indicated by the arrows as seen in FIG. 1.

The fasteners 27 that are located at the top margin of the storm window 20 are spring-loaded at 31. The fastener 27 comprises a screw of sufficient length to firmly anchor the storm window to the window frame 12 and also to serve as a point of pivot to enable the storm window to be pivoted to a closed position as shown in FIG. 2 or to an open position as shown in FIG. 6.

Figure 3:
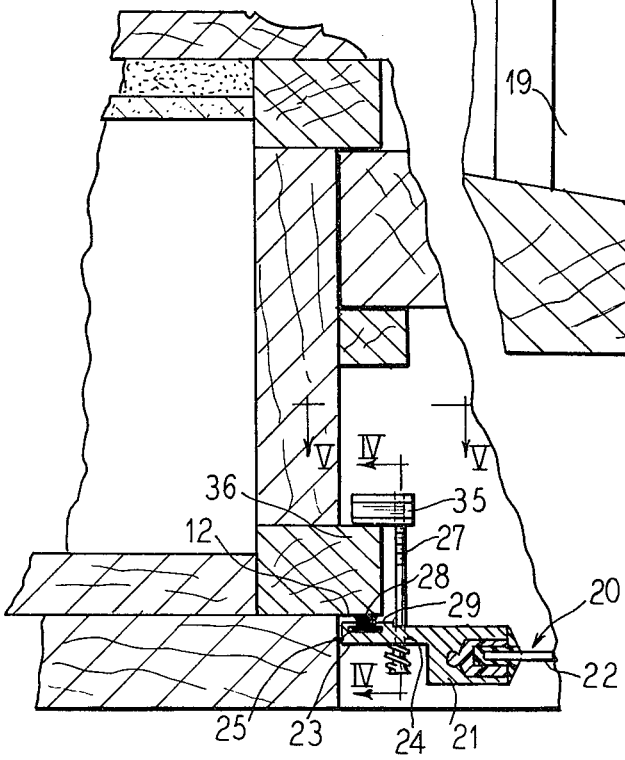
FIG. 3 is an enlarged fragmentary cross-sectional view taken on the lines III—III looking in the direction indicated by the arrows as seen in FIG. 1.
Figure 4:
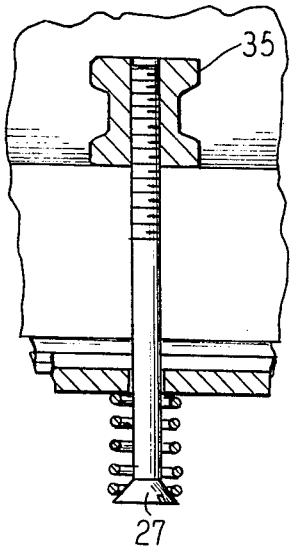
FIG. 4 is an enlarged fragmentary cross-sectional view of a fastener device taken on the line IV—IV looking in the direction indicated by the arrows as seen in FIG. 3.
Figure 5:
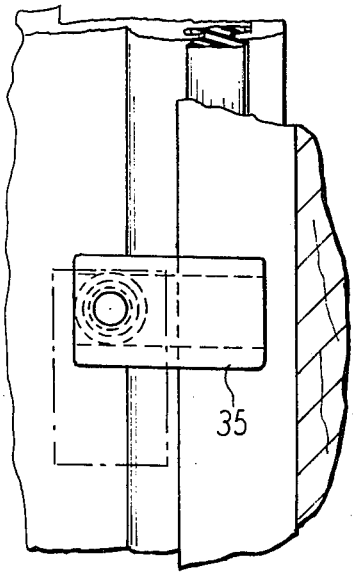
FIG. 5 is an enlarged fragmentary elevational view as viewed on the line V—V looking in the direction indicated by arrows as seen in FIG. 3.

As least certain of the fasteners 27 are provided with rotatable locking dogs 35 which when rotated coact with the angular metallic strips 30 or with an outer frame screen stop 36 (FIG. 3) to snugly mount the storm window in sealed overlapped engagement with respect to double-hung windows 17 and 18.

Figure 6:
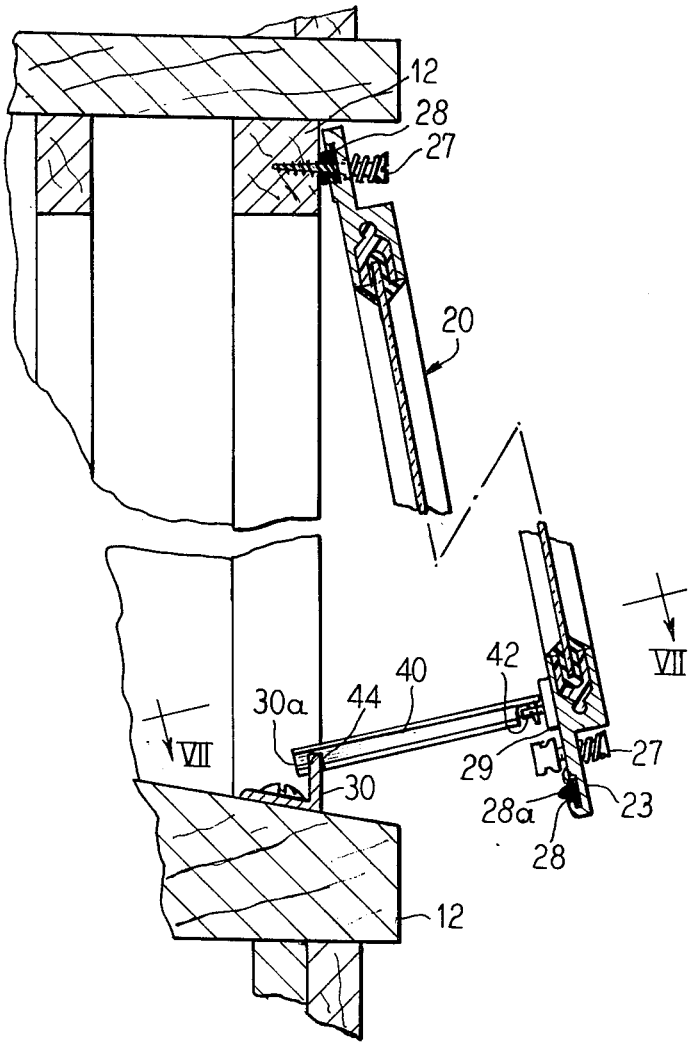
FIG. 6 is an enlarged fragmentary broken view of the storm window structure showing the storm window in an "open" position.

When it is desired to open the storm window 20, as shown in FIG. 6, the two fastners 27 at the sides of the storm window 20 and the two fasteners 27 at the bottom of the storm window 20 are caused to be released by rotating the rotatable locking dogs 35 from an engaged position to a disengaged position. This step can be accomplished from inside of the building merely by lifting the lower inside window 17 to an open position and then the operator can release the dogs 35. Then the operator can manually push the lower end of the storm window 20 outward and cause it to pivot on the fasteners 27 at the top of the window to cause the window to reopen.

Figure 7:
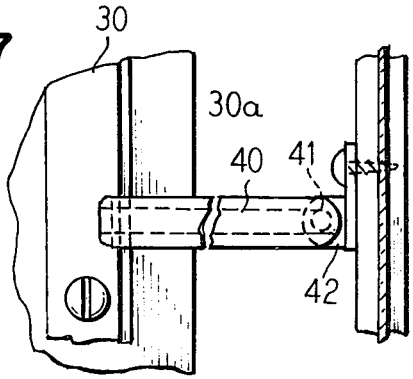
FIG. 7 is an enlarged fragmentary view taken on the line VII—VII looking in the direction indicated by the arrow as seen in FIG. 6.

In order to secure the storm window 20 in an open position, a swingable arm 40 is pivotally mounted at 41 on the inside surfaces 29 of the frame 21 of the storm window 20. The swingable arm has a pin which engages a slot in a log 42 as shown in FIGS. 6 and 7. The opposite end of the swingable arm 40 is slotted at 44 to enable it to be engaged with an upstanding leg end 38 of the angular metallic strip 30.

It will be appreciated that from a consideration of the following test data furnished by a testing company how the combination storm window and the improved window suspension arrangement for mounting the storm window frame provides seals which are of the order of 39 times tighter than current industry standards.

"Subject: One vented single lite storm window for exterior application. Model 400 sampled and submitted by the client for conformance testing to ANSI/AAMA 1002.9-1977, specification HSW-Cl. Further air infiltration requirements of paragraph 456.813 "standards for storm and thermal windows and doors and multiglazed insulating units for windows and doors", Federal Register-Volume 44, No. 217, page 64685, published Nov. 7, 1979 were applied.

Description of Sample: Vented single lite storm window for exterior application, 32⅝" wide by 56½" high with one operating vent 32⅝" wide by 56½" high. Single glazed with SSB glass in a vinyl channel system. Seal was a vinyl bulb all around the vent. The vent was designed to attach to the wooden stops of an existing double hung window with spring loaded screws at the top. The vent opened at the bottom after turning four spring loaded aluminum "Butterfly locks", and pushing the vent to the outside at the bottom. Vent was held in the open position by one aluminum "I" beam ⅝" wide by ⅜" high and about 10" long attached to the vent by a steel hook screwed to the approximate center of the vent sill and notched to fit over an aluminum step screwed to the existing window frame. Two 3/16" round holes located about 5½" from the bottom corners of the vent sill had removable rubber plugs for condensate drainage.

Result of Tests

| Paragraph | Title of Test | Found | Allowed |
|---|---|---|---|
| 2.1.2.1 | Air infiltration Test | 0.11 CFM/FT | 2.0 CFM/Ft of crack |
| 2.1.2.2 | Water Drainage Test | No entry | No entry |
| 2.1.2.3 | Uniform Load Test | | |
| | exterior | conforms | 0.226" |
| | interior | conforms | 0.226" |
| 2.1.2.4 | Concentrated Load & Glass adherence tests, sash. | conforms | ⅛" max. Deflection |
| 2.1.2.5 | Pull Test | 3½ lbs. | 15 lbs. |
| 2.1.2.6 | Glass inserts squareness test | 1/16" max. | 5/16" max. |
| 2.1.2.7 | Attachment of insect screening to frame test | no screens | |

Conclusions:

This product meets or exceeds all performance requirements of the standard and the additional air infiltration requirements imposed by the referenced federal register."

We claim as our invention:

1. In a storm window structure including a storm window for protectively screening out cold air, dirt and the like when mounted upon a window frame carrying at least one window, the improvement of a window suspension arrangement for mounting the storm window frame in assembly with the frame of the window, the storm window frame having a continuous annular resilient synthetic plastic spacer mounted on an inwardly facing surface of the frame for abutment against the frame carrying the window, and spring loaded fasteners extending through said storm window frame for compressing said continuous annular resilient synthetic plastic spacer throughout its annular dimension and for securing the storm window frame in retained engagement with the window frame of the window thus insuring a snug air-tight assemblage of the storm window on the window frame of the window, said window frame on said storm window having an annular inwardly facing retaining groove and with said continuous annular resilient synthetic spacer being retainingly engaged and retained in said groove, at least some of the fasteners extending into said groove and through said spacer in threaded engagement with the window frame carrying the window.

2. The storm window structure of claim 1 further characterized by other of the spring-loaded fasteners having rotatable locking dogs, angular metallic strips anchored to the window frame, each of the dogs being engageable with a rear surface of one of the metallic strips for securing the spring-loaded fasteners in releasable engagement therewith.

3. The storm window structure of claim 2 further characterized by the releasable dogs being rotatable for disengagement from the metallic angular member, and with the release of all of the dogs, the spring-loaded fasteners at the top side of the storm window frame providing points of pivoted engagement between the storm window frame and the window frame, and a swingable arm mounted on the storm window frame and engageable with the annular metallic piece for holding the window frame in an open position at its bottom end when it is desired to vent the storm window frame.

4. The storm window structure of claim 1 further characterized by the spring-loaded fasteners and the continuous annular resilient synthetic plastic spacer coacting with the window frame for creating a seal between the storm window structure and the window frame having a 0.50 cfm/fcp rating or less.

5. The storm window structure of claim 1 further characterized by the spring-loaded fasteners and the continuous annular resilient synthetic plastic spacer coacting with the window frame for creating a seal between the storm window structure and the window frame having a 0.50 cfm/fcp rating or less.

6. The storm window structure of claim 1 further characterized by the spring-loaded fasteners at the top side of the storm window frame providing points of pivotal engagement between the storm window frame and the window frame, and a swingable arm mounted on the storm window frame and engageable with the angular metallic piece for holding the window frame in an open position at its bottom end when it is desired to vent the storm window frame.

7. The storm window structure of claim 1 further characterized by said at least some of the fasteners extending into said groove being those fasteners located only at an upper margin of said storm window frame.

8. The storm window structure of claim 1 further characterized by the window frame being comprised of an extrusion with an outer marginal area being of reduced thickness as compared with an inner marginal area, said inwardly facing retaining groove being disposed in the reduced outer margin and with said at least some of the fasteners extending into said groove being located along an upper most marginal area of the frame and extending through the reduced marginal area into said groove through said continuous annular resilient synthetic spacer and then into a window frame for providing a yieldable pivotal engagement between the storm window frame and the window frame.

9. In a storm window structure including a storm window for protectively screening out cold air, dirt and the like when mounted upon a window frame carrying at least one window, the improvement of a window suspension arrangement for mounting the storm window frame in assembly with the frame of the window, the storm window frame having a continuous annular resilient synthetic plastic spacer mounted on an inwardly facing surface of the frame for abutment against the frame carrying the window, spring loaded fasteners extending through said storm window frame for compressing said continuous annular resilient synthetic plastic spacer throughout its annular dimension and for securing the storm window frame in retained engagement with the window frame of the window thus insuring a snug air-tight assemblage of the storm window on the window frame of the window, the spring-loaded fasteners and the continuous annular resilient synthetic plastic spacer coacting with the window frame for creating a seal between the storm window frame and the window frame having a 0.50 cfm/fcp rating or less, and a swingable arm mounted on the storm window frame and engageable with the window frame for holding the storm window frame in an open position at its bottom end when it is desired to vent the storm window frame upon release of all of the fasteners except along a top edge area of the storm window frame, the fasteners along a top edge area being pivoted to allow a bottom edge area of the storm window frame to be moved away from the window frame and held in open position by the swingable arm.

10. The storm window structure of claim 9 further characterized by said storm window frame having mitered corners and a continuous annular T-shaped groove extending through the corners, the spacer also being T-shaped and snugly engaged at one end in the T-shaped groove and extending out of the groove at its opposite end.

* * * * *